US008235501B2

(12) United States Patent
Oguchi

(10) Patent No.: US 8,235,501 B2
(45) Date of Patent: Aug. 7, 2012

(54) LIQUID EJECTING HEAD UNIT AND LIQUID EJECTING APPARATUS

(75) Inventor: Satoshi Oguchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 362 days.

(21) Appl. No.: 12/711,162

(22) Filed: Feb. 23, 2010

(65) Prior Publication Data

US 2010/0214350 A1 Aug. 26, 2010

(30) Foreign Application Priority Data

Feb. 25, 2009 (JP) ..... 2009-043215

(51) Int. Cl.
*B41J 2/14* (2006.01)
*B41J 29/12* (2006.01)

(52) U.S. Cl. ..... 347/47; 347/108

(58) Field of Classification Search ..... None
See application file for complete search history.

(56) References Cited

U.S. PATENT DOCUMENTS

| | | | | |
|---|---|---|---|---|
| 4,975,143 | A | 12/1990 | Drake et al. | |
| 6,471,335 | B1 * | 10/2002 | Gelbart | 347/49 |
| 7,819,501 | B2 * | 10/2010 | Hanchak et al. | 347/49 |
| 2008/0145130 | A1 * | 6/2008 | Marsden et al. | 400/692 |

FOREIGN PATENT DOCUMENTS

JP 2549762 B2 10/1996

* cited by examiner

*Primary Examiner* — Jerry Rahll
(74) *Attorney, Agent, or Firm* — Kilpatrick Townsend & Stockton LLP

(57) ABSTRACT

A liquid ejecting head unit includes: a plurality of liquid ejecting heads, each of which has a nozzle array in which nozzles ejecting liquid droplets are arrayed; a base plate to which the plurality of liquid ejecting heads are fixed in a state being positioned at predetermined positions thereof; and positioning pins which are fixed to the base plate and engaged with positioning holes formed in the liquid ejecting heads. Each of the positioning pins is held in a holding hole provided in a fixing plate fixed to the base plate. A reference plate is joined to a surface of each of the fixing plates. Further, in each of the reference plates, there are provided: an insertion hole in which the positioning pin is substantially inscribed; and a minute hole that serves as a reference for positioning the positioning pin to the base plate.

6 Claims, 5 Drawing Sheets

LIQUID EJECTING HEAD UNIT AND LIQUID EJECTING APPARATUS

This application claims priority to Japanese Patent Application No. 2009-043215, filed Feb. 25, 2009, the entirety of which is incorporated by reference herein.

BACKGROUND

1. Technical Field

The present invention relates to a liquid ejecting head unit and a liquid ejecting apparatus, which eject liquid droplets, and in particular, relates to an ink jet recording head and an ink jet recording apparatus, which eject ink droplets as the liquid droplets.

2. Related Art

A liquid ejecting apparatus represented by an ink jet recording apparatus such as an ink jet printer and an ink jet plotter includes a liquid ejecting head unit in which a plurality of liquid ejecting heads are provided. The liquid ejecting heads are capable of ejecting, from nozzles, a liquid such as ink reserved in a cartridge, a tank or the like.

The plurality of liquid ejecting heads which configure the liquid ejecting head unit as described above are fixed at predetermined positions of a base plate as a holding member common thereto in a state being positioned with high accuracy. Specifically, the respective liquid ejecting heads are fixed to the base plate in a state where the respective nozzles thereof are positioned with high accuracy. For example, the respective liquid ejecting heads are fixed to the based plate while being positioned with high accuracy so that the plurality of nozzles of the respective liquid ejecting heads may be aligned with one another continuously at a constant pitch in the direction along a nozzle array in which the plurality of nozzles are arrayed.

As a method for positioning the liquid ejecting heads, for example, there is a method of attaching sub units (corresponding to the liquid ejecting heads) onto an alignment substrate (corresponding to the base plate), which is formed of a silicon substrate, while positioning the sub units at predetermined positions on the alignment substrate. Here, such attachment and positioning are performed in such a manner that a key groove and keys are formed by photolithography on the alignment substrate and the sub units, respectively, and the keys are engaged with the key groove. Japanese Patent No. 2,549,762 is an example of this related art.

The respective liquid ejecting heads may be fixed to the base plate while being positioned with high accuracy using the method as described above. However, even if the liquid ejecting heads are positioned to a member such as the silicon substrate capable of positioning with high accuracy using the keys and the key groove as in Japanese Patent No. 2549762, it may be difficult to position the liquid ejecting heads with high accuracy.

For example, in the case where a failure has occurred in one liquid ejecting head in the liquid ejecting head unit including the plurality of liquid ejecting heads, it is not necessary to replace the entirety of the liquid ejecting head unit, but the one liquid ejecting head in which the failure has occurred just needs to be replaced. Therefore, if the liquid ejecting head unit is used for a long period, then attachment and detachment of the liquid ejecting heads to and from the base plate are repeated.

If the attachment and detachment of the liquid ejecting heads to and from the base plate are repeated as described above, then there arises a risk that, for example, such a problem may occur that the keys and the key groove provided on the member formed of the silicon substrate become chipped. Therefore, it should be understood that positional accuracy of the liquid ejecting heads to the base plate may be lowered, resulting in lowering of accuracy in target positions of liquid droplets.

Such a problem exists not only in the member formed of the silicon substrate but also commonly in general positioning members. For example, there is apprehension that positioning portions of the base plate may be worn in that the attachment and detachment of the liquid ejecting heads to and from the base plate are repeated, resulting in lowering of the positional accuracy.

Note that such a problem exists not only in the ink jet recording head unit but also, in a similar way, in a liquid ejecting head unit that ejects a liquid other than ink.

SUMMARY

An advantage of some aspects of the invention is to provide a liquid ejecting head unit and a liquid ejecting apparatus, which are capable of satisfactorily maintaining the positioning accuracy thereof even if the liquid ejecting heads are repeatedly attached and detached to and from the base plate.

According to an aspect of the invention, a liquid ejecting head unit includes: a plurality of liquid ejecting heads, each of which has a nozzle array in which nozzles ejecting liquid droplets are arrayed; a base plate to which the plurality of liquid ejecting heads are fixed in a state being positioned at predetermined positions thereof; and positioning pins which are fixed to the base plate and engaged with positioning holes formed in the liquid ejecting heads. Each of the positioning pins is held in a holding hole provided in a fixing plate fixed to the base plate. Moreover, a reference plate is joined to a surface of each of the fixing plates. Furthermore, in each of the reference plates, there are provided: an insertion hole in which the positioning pin is substantially inscribed; and a minute hole that serves as a reference of positioning the positioning pin to the base plate.

According to the aspect of the invention, each of the positioning pins is fixed to the base plate in a state being positioned with high accuracy. Therefore, each of the heads may be positioned to the base plate extremely easily and highly accurately. Moreover, the positioning accuracy may be satisfactorily maintained even if the liquid ejecting heads are repeatedly attached and detached to and from the base plate.

Here, it is preferable that each of the positioning pins be press-fitted into the holding hole. In such a way, the positioning pin is fixed to the fixing plate satisfactorily and firmly.

Moreover, it is preferable that each of the fixing plates be formed of a metal material. Accordingly, the positioning pin is fixed to the fixing plate more satisfactorily.

In the case where each of the liquid ejecting heads includes: a liquid ejecting head body having a pressure generation unit for ejecting the liquid droplets from the nozzles; and a head case having a supply path for supplying a liquid to the liquid ejecting head body, it is preferable that each of the fixing plates be formed of a material of which coefficient of thermal expansion is equal to that of the head case. Furthermore, it is preferable that each of the fixing plates be formed of a material of which coefficient of thermal expansion is equal to that of the reference plate. Accordingly, variations of relative positions among the respective heads, which are caused by heat, may be suppressed from occurring when fixing the heads to the base plate, and so on.

According to another aspect of the invention, a liquid ejecting apparatus includes the liquid ejecting head unit as described above. The aspect of the invention provides a liquid ejecting apparatus, which is capable of positioning the liquid ejecting heads simply and with high accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
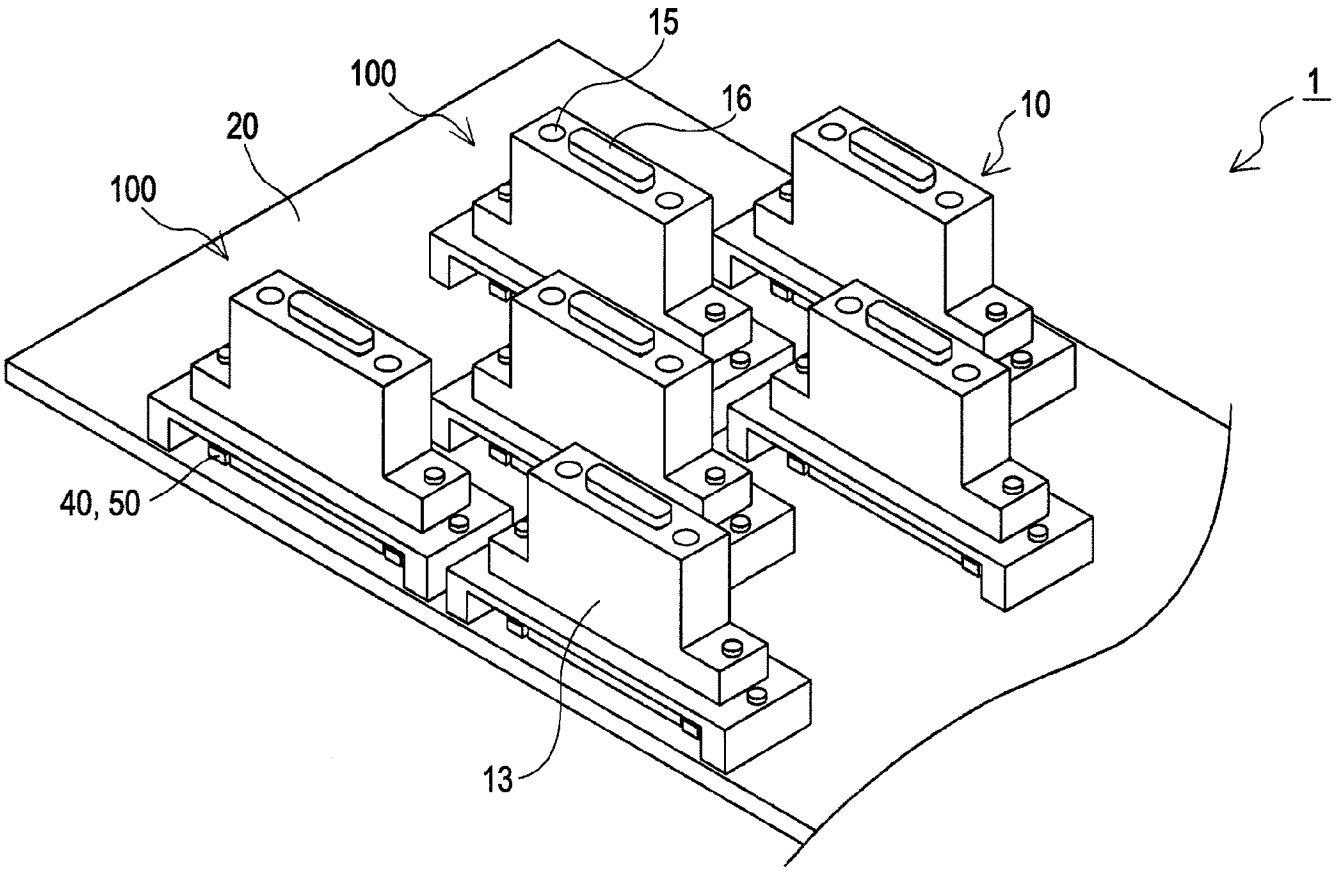
FIG. 1 is a perspective view illustrating an outline of a head unit.
Figure 2:
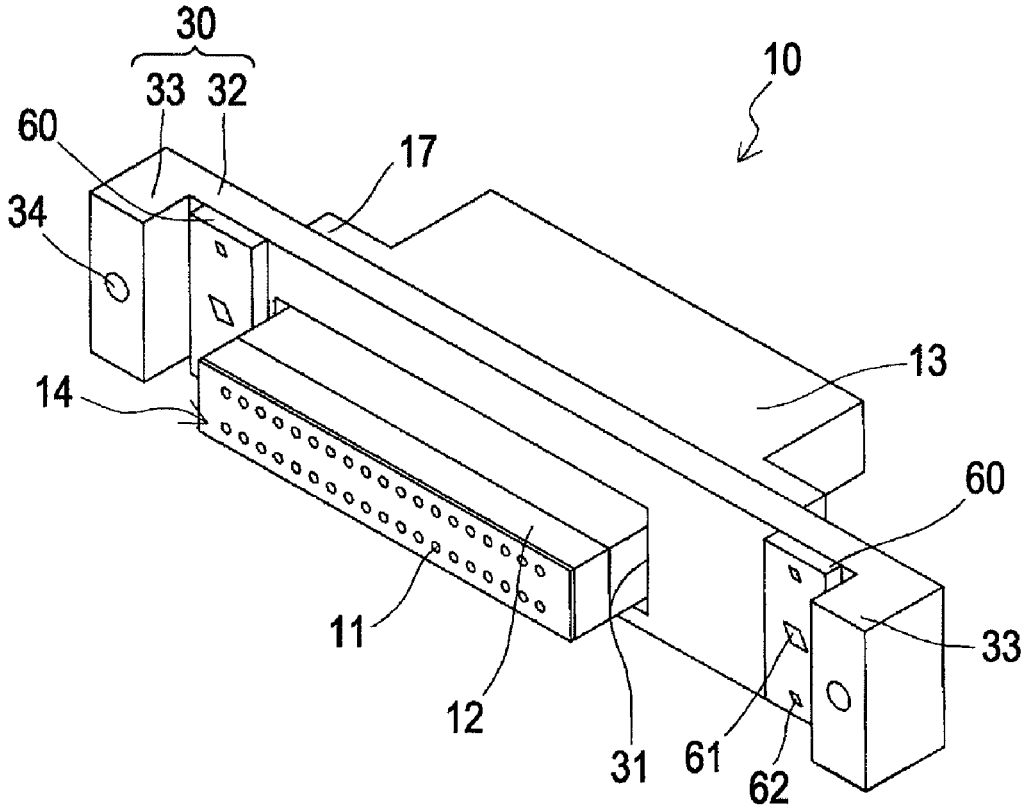
FIG. 2 is a perspective view illustrating an outline of a head.

The invention is described as below in detail on the basis of embodiments.

First Embodiment

As shown in FIGS. 1 to 4, an ink jet recording head unit 1 (hereinafter referred to as a "head unit") of this embodiment includes: a plurality of ink jet recording heads 10 (hereinafter referred to as "heads"); and a base plate 20 to which the plurality of heads 10 are fixed in a state being positioned at predetermined positions thereof.

For example, in the embodiment, the plurality (for example, three) of heads 10 are arranged along nozzle arrays 14 in which nozzles 11 are arrayed, whereby a head group 100 is configured, and on the base plate 20, two head groups 100 are provided in parallel to each other in the direction perpendicular to the nozzle arrays 14. The plurality of heads 10 which configure the respective head groups 100 are arranged in a zigzag fashion, and all of the nozzles 11 of the plurality of heads 10 are arranged at a predetermined pitch in the direction along the nozzle arrays 14.

In the base plate 20, through-holes 21 which penetrate the base plate 20 in a thickness direction thereof are provided so as to correspond to the respective heads 10. Specifically, the respective heads 10 are fixed to the base plate 20 in a state being inserted through the respective through-holes 21.

Each of the heads 10 includes: a head body 12 having the plurality of nozzles 11 on one end surface thereof; and a head case 13 fixed to a surface of the head body 12, which is opposite to the one end surface having the nozzles 11. For example, in this embodiment, the head body 12 includes two rows of the nozzle arrays 14 in which the nozzles 11 are arrayed. Moreover, inside of the head body 12, though not shown, there are provided: a pressure generation chamber that composes a part of a flow path communicating with the nozzles 11; and a pressure generation unit that causes a pressure change in the pressure generation chamber, thereby allows ink to be ejected from the nozzles 11.

No particular limitations are imposed on the pressure generation unit. For example, the pressure generation units are: a unit that uses a piezoelectric element in which a piezoelectric material exhibiting an electromechanical conversion function is sandwiched by two electrodes; a unit that allows liquid droplets to be ejected from the nozzles 11 with bubbles generated by heat of a heating element, which is arranged in a pressure generation chamber; a unit that generates static electricity between a vibration plate and an electrode, and deforms the vibration plate by electrostatic force, thereby allows the liquid droplets to be ejected from the nozzles 11; and the like. As the piezoelectric element, there are: a piezoelectric element of a flexural vibration type, which is formed by stacking a lower electrode, the piezoelectric material and an upper electrode in order from the pressure generation chamber side, and is flexurally deformed; a piezoelectric element of a longitudinal vibration type, which is formed by stacking the piezoelectric material and an electrode forming material alternately on each other, and is extended and contracted in the axial direction; and the like.

The head case 13 has a supply path 15 for supplying the ink, which comes from an ink reservoir (not shown) such as an ink tank, to the head body 12. A drive wire (not shown) connected to the above-described piezoelectric element or the like is housed in the head case 13, and a connector 16 to be connected to the drive wire is provided on a surface of the head case 13, which is opposite to the head body 12.

Each of the heads 10 as described above is fixed to the base plate 20 while interposing a sub plate 30 therebetween. The sub plate 30 is configured of: a base portion 32 in which a head insertion hole 31 is provided; and a leg portion 33 provided to protrude from the base portion 32 on the nozzles 11 side. The sub plate 30 is fixed to the head 10 in a state where the head 10 is inserted through the head insertion hole 31. Specifically, the base portion 32 of the sub plate 30 is fixed to a flange portion 17, which are provided on an outer peripheral portion of the head case 13, with fixing screws 18.

Fixing screw insertion holes 34 are formed in the leg portions 33 of the sub plate 30. The fixing screw insertion holes 34 penetrate the leg portions 33 in the thickness direction thereof, and fixing screws 35 are inserted through the fixing screw insertion holes 34. The sub plate 30 is fixed to the base plate 20 with the fixing screws 35. Specifically, in the base plate 20, fixing member insertion holes 22 to which the fixing screws 35 are screwed are provided more outside than fixing plates 40 (described later) in the direction of the nozzle arrays 40. The head 10 is formed more inside than the fixing plates 40.

Each of the heads 10 fixed to the base plate 20 by the sub plates 30 as described above is positioned with high accuracy by positioning pins 23 fixed to the base plate 20 as will be described below.

Figure 3:
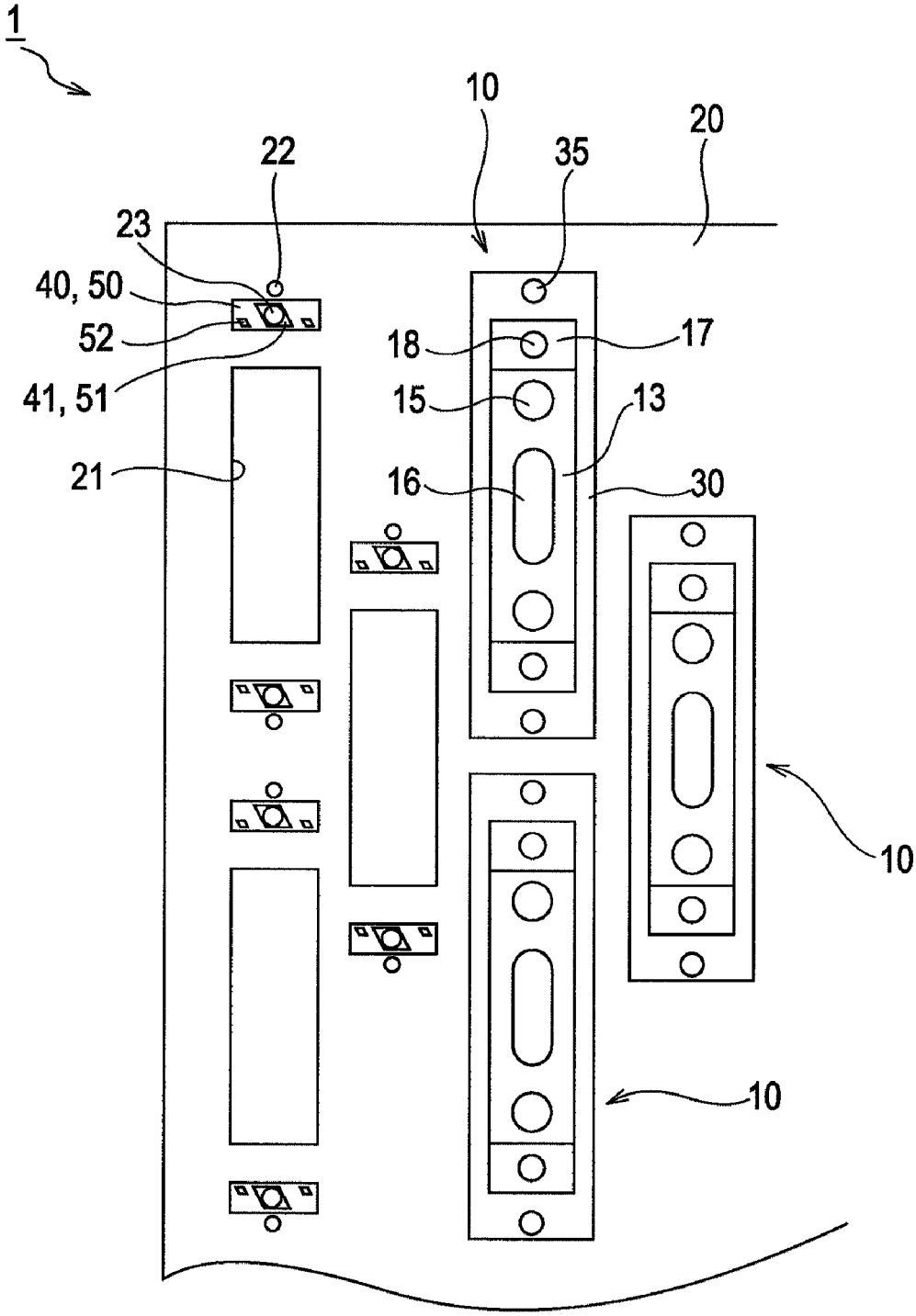
FIG. 3 is a plan view illustrating the outline of the head unit.
Figure 4:
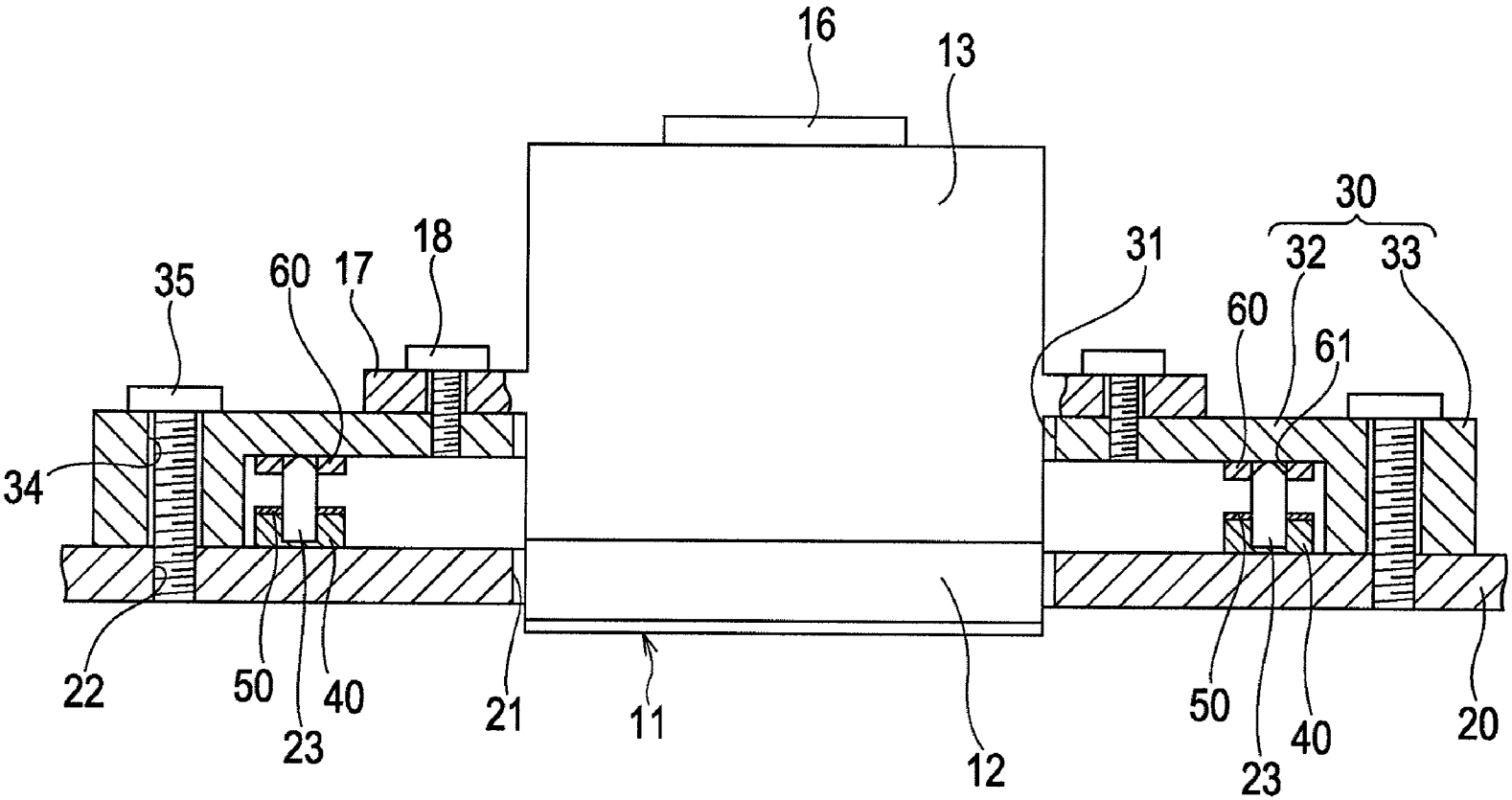
FIG. 4 is a sectional view illustrating an outline of the head unit in the direction of a nozzle array.
Figure 5:
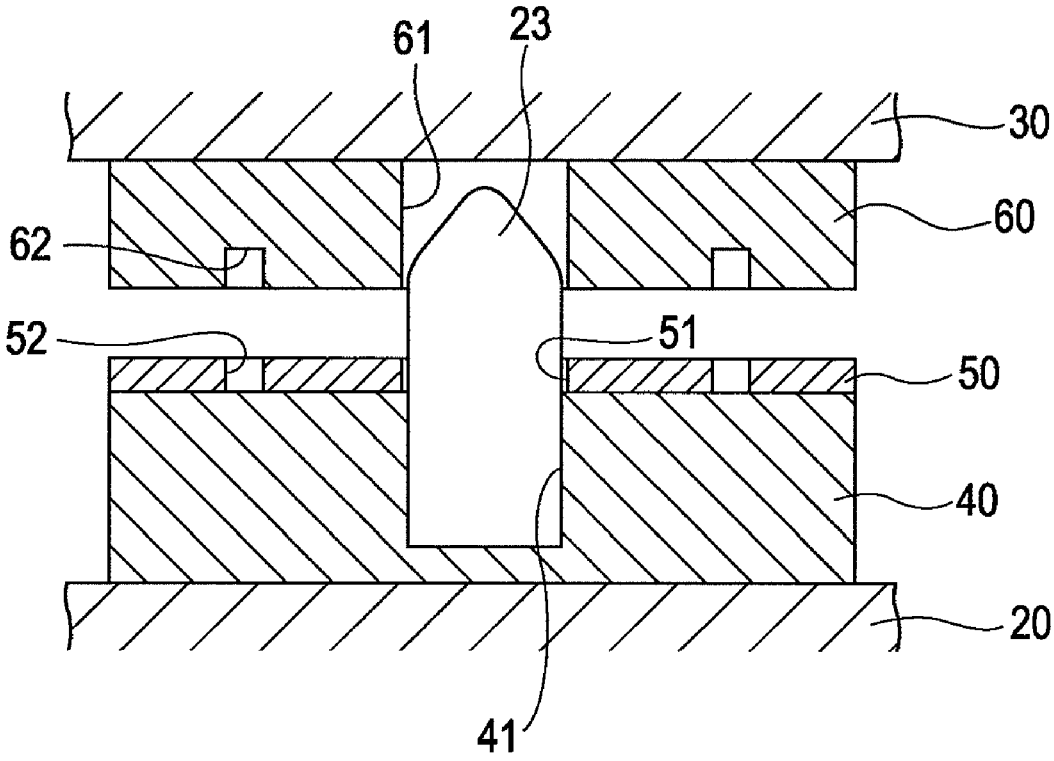
FIG. 5 is a sectional view of a fixing plate portion in the direction perpendicular to the nozzle array.

As shown in FIGS. 3 to 5, the positioning pins 23 made of, for example, a metal material are fixed to the fixing plates 40. The fixing plates 40 are fixed to predetermined positions of the base plate 20 in a state being positioned with high accuracy. In this embodiment, the fixing plates 40, to which the positioning pins 23 are fixed, are fixed to both regions of the base plate 20, which are more outside than each of the through-holes 21 in the direction of the nozzle arrays 14, in a state being positioned with high accuracy (refer to FIG. 3).

Each of the fixing plates 40 has a holding hole 41 drilled in the direction substantially perpendicular to a surface thereof, and each of the positioning pins 23 is held by being inserted through the holding hole 41. Specifically, the positioning pin 23 is held by the holding hole 41, whereby desired perpendicularity thereof with respect to the fixing plate 40 is ensured. The fixing plate 40 is made of, for example, a metal material, and the holding hole 41 is formed to have an inner diameter a little smaller than an outer diameter of the positioning pin 23. The positioning pin 23 is press-fitted into the holding hole 41. The positioning pin 23 is press-fitted into the holding hole 41 as described above, whereby the positioning pin 23 may be satisfactorily fixed to the fixing plate 40.

As a matter of course, as long as the positioning pin 23 may be satisfactorily fixed to the fixing plate 40, the positioning pin 23 does not always have to be press-fitted into the holding hole 41, or no particular limitations are imposed on the material of the fixing plate 40. However, it is preferable to use a metal material as the material of the fixing plate 40 in consideration of machining accuracy and the like for the holding hole 41.

Note that, though no particular limitations are imposed on a method of fixing the fixing plate 40 to the base plate 20, for example, the fixing plate 40 just needs to be fixed to the base plate 20 with a fastening member such as a screw from the base plate 20 side (not shown).

A reference plate 50 formed of a silicon substrate is joined to a surface of the fixing plate 40. An insertion hole 51 through which the positioning pin 23 is inserted is formed in the reference plate 50. The insertion hole 51 communicates with the holding hole 41 in a state where the reference plate 50 is joined to the fixing plate 40. The insertion hole 51 is formed to have a size allowing the positioning pin 23 to be substantially inscribed therein. In other words, the insertion hole 51 is formed to have an inner diameter substantially the same as the outer diameter of the positioning pin 23 so that the positioning pin 23 may be smoothly inserted therethrough. Moreover, in the reference plate 50, minute holes 52 are formed, which serve as positioning references for the positioning pin 23 (fixing plate 40) with respect to the base plate 20.

The reference plate 50 is formed, for example, of a monocrystalline silicon substrate in which a crystal plane orientation is (110), and the insertion hole 51 and the minute holes 52 are formed by anisotropically etching the monocrystalline silicon substrate. Since the insertion hole 51 and the minute holes 52 are formed by etching the silicon substrate as described above, the insertion hole 51 and the minute holes 52 are positioned to each other with high accuracy. Accordingly, the minute holes 52 and the positioning pin 23 are positioned to each other with high accuracy.

A material of the reference plate 50 is not limited to the monocrystalline silicon substrate, and may be one formed by performing fine press working for a thin metal plate, or one formed by performing wire electrical discharge machining for the same thin metal plate. Even in the case of using the reference plate 50 formed as described above, similar effects to those in the case of using the reference plate 50 formed of the monocrystalline silicon substrate are obtained. In other words, it is not necessary to limit the material of the reference plate 50 to a specific one as long as the material may be subjected to highly accurate fine machining.

Hence, each of the positioning pins 23 (fixing plates 40) is positioned to the base plate 20 while taking the minute holes 52 as references, whereby each of the positioning pins 23 may be positioned with extremely high accuracy in the in-plane direction of the base plate 20.

When the nozzles 11 are arrayed in density as high as, for example, up to 720 dpi, it is necessary to position each of the heads 10 with extremely high accuracy in micron order. The positioning pin 23 (fixing plate 40) is positioned by image processing using, for example, a CCD camera and the like, and it is necessary to process an image of the positioning pin 23 under extremely high magnification. Therefore, it is difficult to take, as a reference, the insertion hole 51 that has a relatively large opening and allows the positioning pin 23 to be inserted therethrough, and it is necessary to take, as references, the minute holes 52 formed separately from the insertion hole 51.

In the embodiment of the invention, as described above, the reference plate 50 formed of the silicon substrate is provided on the surface of the fixing plate 40, and the insertion hole 51 and the minute holes 52 are formed in the reference plate 50. Accordingly, the insertion hole 51 and the minute holes 52 are positioned to each other with high accuracy. Hence, the minute holes 52 are taken as references, thereby the insertion hole 51, that is, the positioning pin 23 (fixing plate 40) may be positioned with high accuracy.

Note that, while the fixing plate 40 to which the positioning pin 23 is fixed is formed of, for example, a metal material, it is particularly preferable that the fixing plate 40 be formed of a material of which coefficient of thermal expansion is equal to each head case 13 that configures the head 10. Moreover, it is preferable that the fixing plate 40 be formed of a material of which coefficient of thermal expansion is equal to the reference plate 50 formed of a silicon substrate. Accordingly, variations of relative positions among the respective heads 10, which are caused by heat, may be suppressed from occurring in the event of fixing the heads 10 to the base plate 20, and so on.

It is preferable to join the reference plate 50 to the fixing plate 40 after the positioning pin 23 is press-fitted into the holding hole 41 of the fixing plate 40. In such a way, the insertion hole 51 of the reference plate 50 and the holding hole 41 of the fixing plate 40 may be positioned to each other extremely easily. As long as the insertion hole 51 and the holding hole 41 may be positioned to each other with high accuracy, the positioning pin 23 may be press-fitted into the insertion hole 51 and the holding hole 41 after the reference plate 50 is joined to the fixing plate 40.

Meanwhile, a positioning plate 60 is attached onto a nozzles 11-side surface of the base portion 32 of the sub plate 30. In the positioning plate 60, a positioning hole 61 is formed, through which a tip end portion of the positioning pin 23 is inserted. The positioning plate 60 is fixed to the sub plate 30 so that the positioning hole 61 may be positioned to the nozzles 11 with high accuracy.

For example, the positioning plate 60 has minute holes 62, which are formed of a silicon substrate in a similar way to the above-mentioned reference plate 50, and are positioned with high accuracy to the positioning hole 61. In other words, the positioning hole 61 and the minute holes 62 are formed, for example, by anisotropically etching a silicon substrate in which a crystal plane orientation is (110). The positioning plate 60 is fixed to the sub plate 30 in a state where, for example, by the image processing, the positioning hole 61 is positioned with high accuracy while taking the minute holes 62 as references.

Note that, though it is preferable to use, as a material of the positioning plate 60, the silicon substrate capable of forming the positioning hole 61 and the minute holes 62 with high accuracy as described above, no particular limitations are imposed on the material of the positioning plate 60 as long as the positioning hole 61 and the minute holes 62 may be formed with high accuracy.

In the configuration of this embodiment as described above, when fixing each head 10 (sub plate 30) to the base plate 20, the head 10 may be positioned to the base plate 20 with high accuracy only by inserting the tip end portion of the positioning pin 23, which is fixed to the base plate 20, through the predetermined positioning hole 61. Hence, a replacement operation of the heads 10 becomes extremely easy. In other words, since it becomes unnecessary to positionally align the respective heads 10 by using the CCD camera and the like, such alignment of the heads 10 may be performed easily without taking labor and time. For example, even when replacing the heads 10 at a site where a liquid ejecting apparatus including the head unit 1 is actually used, the heads 10 may be replaced relatively easily.

The positioning pin 23 is made, for example, of a material such as a metal material that is less likely to be worn. Therefore, if the positioning pin 23 is fixed to the base plate 20, then lowering of positional accuracy of each head 10 is suppressed from occurring even if the replacement of the head 10 is repeated. Hence, ejection characteristics of the head unit 1 may be maintained satisfactorily for a long period even if the replacement operation of the head 10 is repeated.

Furthermore, the positioning plate 60 does not abut against the reference plate 50 provided for positioning each head 10 to the base plate 20, and accordingly, the reference plate 50 that contributes to the highly accurate positioning is hardly worn. The ejection characteristics of the head unit 1 may be maintained satisfactorily for a long period even if the replacement operation of the head 10 is repeated.

Note that, in the above-mentioned example, the positioning hole 61 into which the tip end portion of the positioning pin 23 is inserted is formed in the positioning plate 60 formed of the silicon substrate. Accordingly, the positioning plate 60 is prone to be broken at the time of replacing the head 10. It is not preferable that the positioning plate 60 be provided on the base plate 20. Therefore, the positioning plate 60 is formed on the sub plate 30 that serves as a consumable article. However, in the case where the positioning plate 60 is made of a material that is less likely to be broken, the positioning plate 60 may be fixed to the base plate 20, and the positioning pin 23 (fixing plate 40) may be fixed to the sub plate 30.

Other Embodiment

Although the description of the embodiment of the invention has been made above, the invention is not limited to the above-mentioned embodiment. For example, though in the above-mentioned embodiment, the description has been made of the example where the insertion hole 51 and the minute holes 52 are formed in the reference plate 50, for example, an adjustment hole may be further formed in the reference plate 50. Into the adjustment hole, an adjustment arm for positioning the fixing plate 40 to the base plate 20 is inserted. In such a way, the fixing plate 40 may be positioned with more ease and higher accuracy.

In the above-mentioned embodiment, though two rows of the nozzle arrays 14 are provided in each head 10, the number of rows is not particularly limited to two, and one row of the nozzle array 14 may be provided in each head 10, or three or more rows thereof may be provided in each head 10. Furthermore, though each head group 100 is configured of three heads 10 in the above-mentioned embodiment, the number of heads 10 in each head group 100 is not particularly limited to three, and each head group 100 may be configured of two heads 10, or may be of four or more heads 10.

Moreover, though two head groups 100 are provided in the head unit 1 in the above-mentioned embodiment, the number of head groups 100 in the head unit 1 is not particularly limited to two, and may be one, or three or more.

Though each head 10 includes the sub plate 30 in the above-mentioned embodiment, the invention is not particularly limited to this configuration, and the positioning plate 60 may be directly attached to the head case 13, and the head case 13 may be positioned and fixed to the base plate 20.

While each head 10 includes the positioning plate 60 in which the positioning hole 61 is formed in the above-mentioned embodiment, the positioning hole 61 may be formed, for example, in a member such as the head case 13 that configures the head 10.

The head unit of the embodiment of the invention as described above is applicable to a so-called line-type ink jet recording apparatus that performs printing on a recording medium such as a recording sheet by transporting the recording medium in the direction perpendicular to a direction of the nozzle arrays. Further, the head unit of the embodiment of the invention is applicable not only to the line-type ink jet recording apparatus but also to other types of ink jet recording apparatuses. For example, the head unit of the embodiment of the invention is also applicable to an ink jet recording apparatus of a type that performs printing while moving a carriage, on which the head unit is mounted, in the direction perpendicular to a transporting direction of the recording medium.

As a matter of course, the ink jet recording apparatus is merely an example of the liquid ejecting apparatus, and the invention is also applicable to liquid ejecting apparatuses other than the ink jet recording apparatus.

What is claimed is:

1. A liquid ejecting head unit comprising:

a plurality of liquid ejecting heads, each of which has a nozzle array in which nozzles ejecting liquid droplets are arrayed;

a base plate to which the plurality of liquid ejecting heads are fixed in a state being positioned at predetermined positions thereof; and positioning pins which are fixed to the base plate and engaged with positioning holes formed in the liquid ejecting heads, wherein each of the positioning pins is held in a holding hole provided in a fixing plate fixed to the base plate, a reference plate is joined to a surface of the fixing plate, and in the reference plate, there are provided: an insertion hole in which the positioning pin is substantially inscribed; and a minute hole that serves as a reference for positioning the positioning pin to the base plate.

2. The liquid ejecting head unit according to claim 1, wherein each of the positioning pins is press-fitted into the holding hole.

3. The liquid ejecting head unit according to claim 1, wherein each of the fixing plates is formed of a metal material.

4. The liquid ejecting head unit according to claim 1, wherein each of the liquid ejecting heads includes: a liquid ejecting head body having a pressure generation unit for ejecting the liquid droplets from a nozzle; and a head case having a supply path for supplying a liquid to the liquid ejecting head body, and each of the fixing plates is formed of a material of which coefficient of thermal expansion is equal to the coefficient of thermal expansion of the head case.

5. The liquid ejecting head unit according to claim 1, wherein each of the fixing plates is formed of a material of which coefficient of thermal expansion is equal to the coefficient of thermal expansion of the reference plate.

6. A liquid ejecting apparatus comprising:

the liquid ejecting head unit according to claim 1.

* * * * *